US007111441B2

(12) United States Patent
Spatafora

(10) Patent No.: US 7,111,441 B2
(45) Date of Patent: Sep. 26, 2006

(54) METHOD AND DEVICE FOR PRODUCING A CONTAINER

(75) Inventor: Mario Spatafora, Granarolo (IT)

(73) Assignee: G.D Societa'per Azioni, Bologna (IT)

( * ) Notice: Subject to any disclaimer, the term of this patent is extended or adjusted under 35 U.S.C. 154(b) by 77 days.

(21) Appl. No.: 10/984,939

(22) Filed: Nov. 10, 2004

(65) Prior Publication Data

US 2005/0120681 A1 Jun. 9, 2005

(30) Foreign Application Priority Data

Nov. 13, 2003 (IT) ..... BO2003A0671

(51) Int. Cl.
*B65B 11/00* (2006.01)
*B65B 5/06* (2006.01)

(52) U.S. Cl. ..... 53/462; 53/452; 53/456; 53/458; 493/162; 493/911

(58) Field of Classification Search ..... 53/452, 53/456, 458, 461, 462; 493/162, 183, 910, 493/911; 206/268; 229/160.1
See application file for complete search history.

(56) References Cited

U.S. PATENT DOCUMENTS 4,447,003 A * 5/1984 Gray ..... 229/160.1
4,526,317 A * 7/1985 Cassidy ..... 229/160.1
5,044,550 A * 9/1991 Lamm ..... 229/160.1
5,097,948 A * 3/1992 Campbell ..... 206/268
5,143,282 A * 9/1992 Pham ..... 229/160.1
5,203,495 A * 4/1993 Jorgensen-Beck et al. ..... 229/160.1
5,366,077 A * 11/1994 Pham ..... 206/268
5,478,011 A * 12/1995 Pham ..... 229/160.1
6,370,846 B1 4/2002 Schoch et al.
6,694,703 B1 * 2/2004 Grossmann et al. ..... 53/228
6,694,708 B1 * 2/2004 Brizzi et al. ..... 53/462
6,755,300 B1 * 6/2004 Brizzi ..... 229/160.1
6,974,027 B1 * 12/2005 Boriani et al. ..... 206/268

FOREIGN PATENT DOCUMENTS

DE 102 08 289 A 9/2003
WO WO 2003/080474 A 10/2003

* cited by examiner

*Primary Examiner*—Louis Huynh
(74) *Attorney, Agent, or Firm*—Birch, Stewart, Kolasch & Birch, LLP

(57) ABSTRACT

A method and device for producing a rigid container, having two end walls and a lateral wall, from a flat blank having two flat first portions, each of which has a relative panel defining a relative end wall of the container, and a drawn rim integral with the panel, extending along at least one portion of an outer edge of the panel, and square with respect to the panel; and three flat second portions alternating with the two panels; each panel being folded squarely with respect to the flat second portions adjacent to it; the second portions being wrapped about and onto the rims to form the lateral wall; and each panel being stiffened by means of an external stiffening member, at least when forming the lateral wall.

9 Claims, 4 Drawing Sheets

METHOD AND DEVICE FOR PRODUCING A CONTAINER

BACKGROUND OF THE INVENTION

More specifically, the present invention relates to a method and device for producing a rigid container, comprising two end walls and a lateral wall, from a flat blank comprising two flat first portions, each of which comprises a panel defining a relative said end wall of the container, and a drawn rim integral with the panel and extending, squarely with respect to the panel, along at least one portion of an outer edge of the panel; and three flat second portions alternating with said two panels; each said panel being folded squarely with respect to the flat second portions adjacent to it, and said second portions being wrapped about and onto said rims to form said lateral wall.

Though suitable for producing any type of container, the present invention is particularly advantageous for use in the tobacco industry, for producing, on a packing machine, containers defined by hinged-lid cigarette packets, and particularly hinged-lid packets having a substantially oval cross section, as described and illustrated in the Applicant's International Patent Application N. WO-A-03/080474, to which the following description refers purely by way of example.

Particularly when working with high-speed packing machines operating at an output speed in the region of 7–10 packets a second, producing packets of the above type poses various difficulties, due to possible inward flexing of the rims when said second portions are wrapped about and onto the rims of said first portions, thus resulting, in view of the relatively small transverse dimensions of the rims, in failure to close the packets.

SUMMARY OF THE INVENTION

It is an object of the present invention to provide a method of producing a container of the type described above, designed to provide a straightforward, low-cost solution to the above problems.

According to the present invention, there is provided a method of producing a rigid container for a product, the container comprising two end walls and a lateral wall, and being formed from a flat blank comprising two first portions, each of which comprises a relative panel defining a relative said end wall of the container, and a drawn rim integral with the panel, extending along at least one portion of an outer edge of the panel, and square with respect to the panel; and three second portions alternating with said two panels, one of said second portions being an intermediate second portion with respect to said two panels; the method comprising the steps of folding each said panel squarely with respect to the second portions adjacent to it, and wrapping said second portions about and onto said rims to form said lateral wall; and being characterized by comprising the further step of stiffening each said panel at least during said step of forming said lateral wall.

According to the present invention, there is also provided a device for producing a rigid container for a product, the container comprising two end walls and a lateral wall, and being formed from a flat blank comprising two first portions, each of which comprises a relative panel defining a relative said end wall of the container, and a drawn rim integral with the panel, extending along at least one portion of an outer edge of the panel, and square with respect to the panel; and three second portions alternating with the two panels, one of said second portions being an intermediate second portion with respect to said two panels; the device comprising first folding means for folding said panels into respective square positions with respect to the second portions adjacent to them; and second folding means for wrapping said second portions about and onto the rims to form said lateral wall; the device being characterized by comprising, for each said panel, stiffening means for stiffening each panel at least when the panel, in use, is in the relative said square position.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
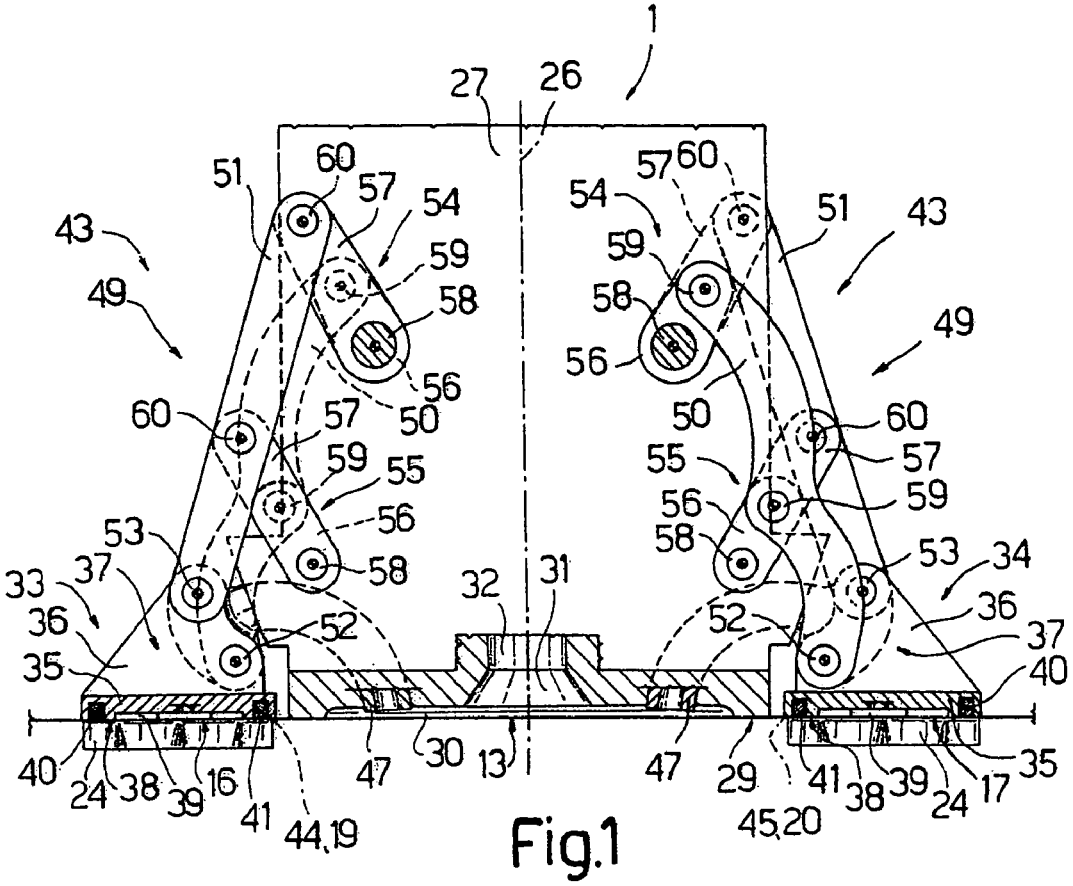
FIG. 1 shows, schematically and partly in section, a preferred embodiment of the device according to the present invention.

Number 1 in FIG. 1 indicates as a whole a folding device for producing a rigid packet 2 of cigarettes from a blank 3.

Figure 4:
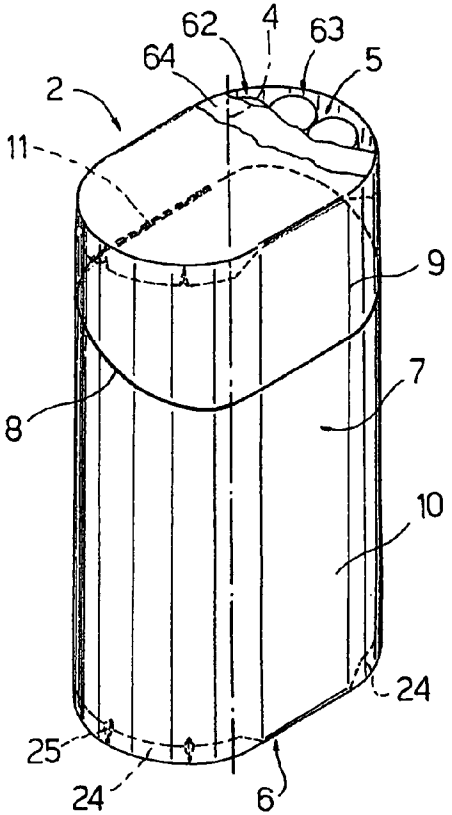
FIG. 4 shows a larger-scale view in perspective of a packet produced by the FIG. 1 device.

As shown in FIG. 4, packet 2 has a longitudinal axis 4, and comprises two substantially oval end walls 5 and 6; and a tubular lateral wall 7, on which a cut line 8 defines a lid 9, incorporating end wall 5, and a body 10, incorporating end wall 6, connected to each other by a hinge 11 aligned with cut line 8.

Figure 5:
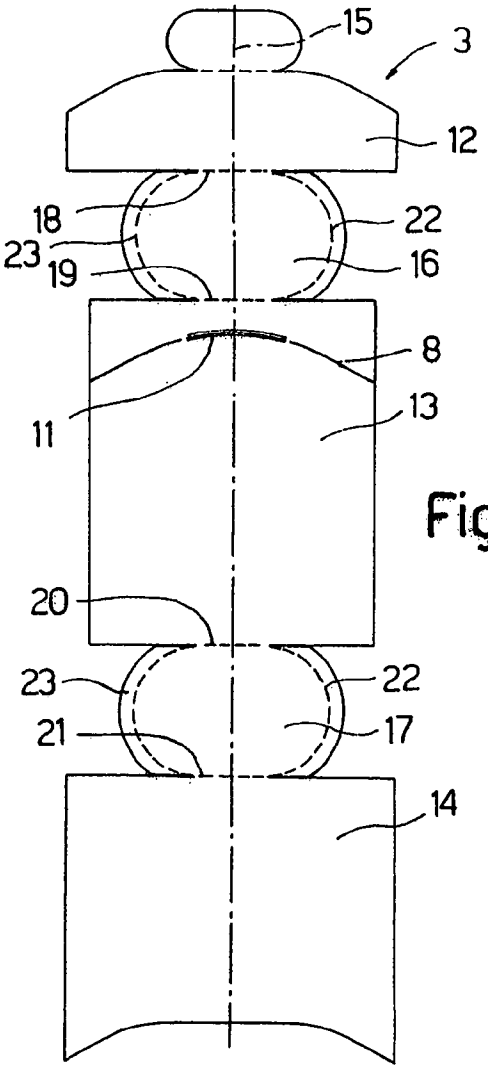
FIG. 5 shows a plan view of a blank which is folded by the FIG. 1 device to produce the FIG. 4 packet.

As shown in FIG. 5, blank 3 comprises three substantially rectangular panels 12, 13, 14 aligned along a longitudinal axis 15, and of which panel 13 is divided into two parts by cut line 8 and hinge 11; and two substantially oval panels 16, 17. Panel 16 is interposed between panels 12 and 13, and is connected to panels 12 and 13 along respective preformed fold lines 18 and 19, both crosswise to longitudinal axis 15; and panel 17 is interposed between panels 13 and 14, and is connected to panels 13 and 14 along respective preformed fold lines 20 and 21 parallel to preformed fold lines 18 and 19.

Panels 16 and 17 are used to form end walls 5 and 6 of packet 2, and panels 12, 13 and 14 for forming lateral wall 7 of packet 2.

Along two curved outer peripheral portions 22 located specularly with respect to longitudinal axis 15, each panel 16, 17 has two curved strips 23, each of which projects outwards from relative portion 22, and is subsequently drawn, prior to any further folding of blank 3, to form a relative rim 24 (FIG. 4) projecting squarely from relative panel 16, 17 and which provides for supporting and connecting the relative-axial end of lateral wall 7 of packet 2.

Figure 7:
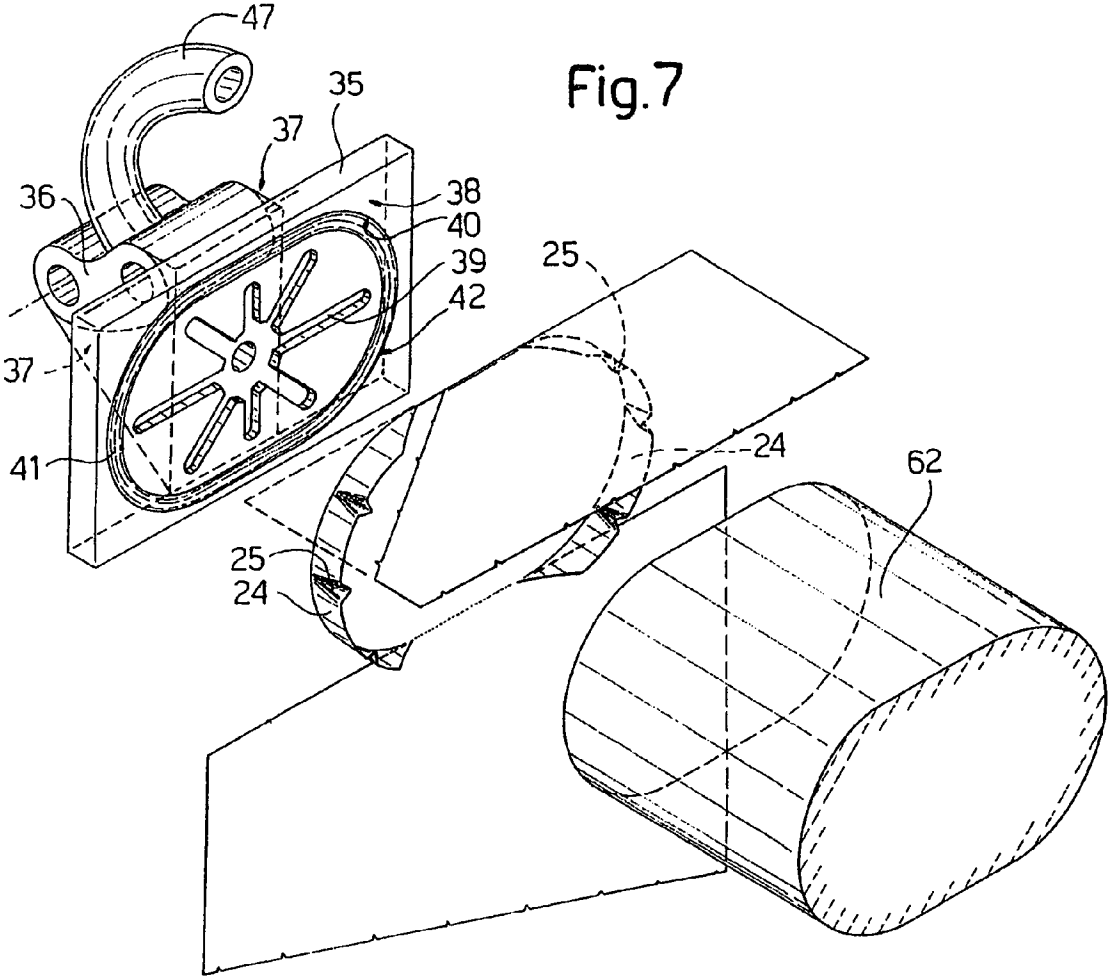
FIG. 7 shows a larger-scale, exploded view in perspective of a detail in FIG. 3.

As shown more clearly in FIG. 7, the drawing operation referred to above forms, along each rim 24, pleats 25 projecting inwards with respect to relative rim 24 and for receiving glue, which performs the dual function of ensuring firm connection of lateral wall 7 to relative end wall 5, 6, and, when dried, of strengthening relative rim 24.

Figure 2:
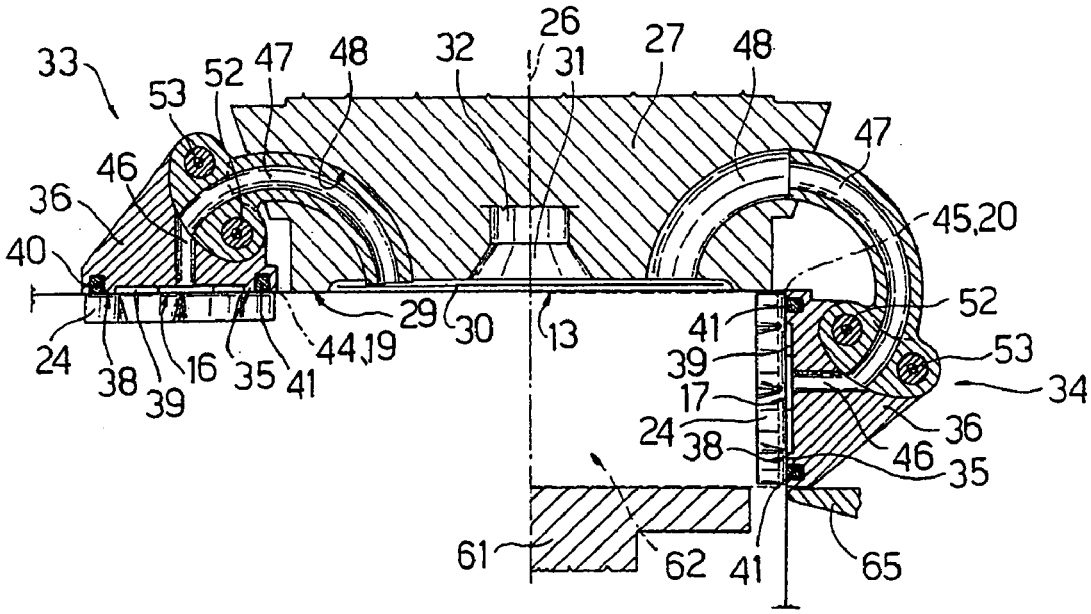
FIG. 2 shows a section of a detail in FIG. 1 in two distinct operating positions.
Figure 3:
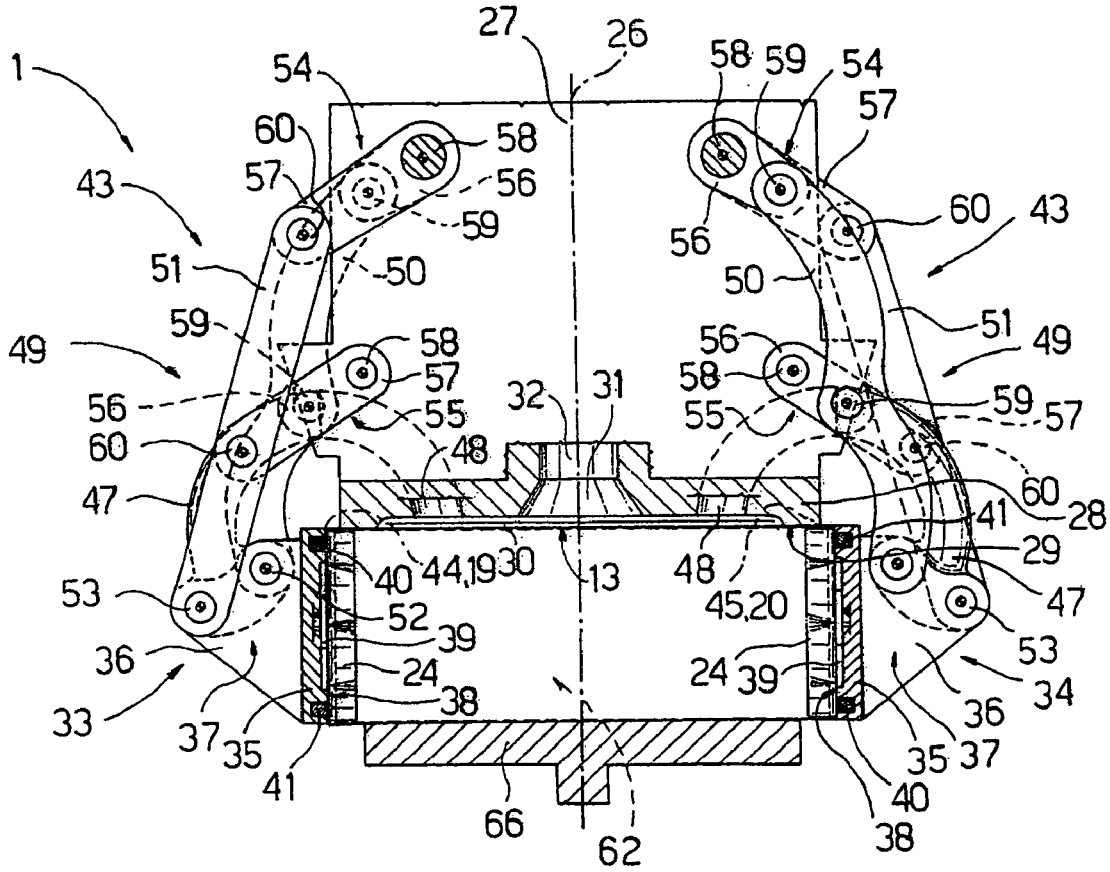
FIG. 3 is similar to FIG. 1, and shows the FIG. 1 device in a further operating position.

As shown in FIGS. 1 to 3, folding device 1 has a longitudinal axis 26, and comprises a frame 27 bounded at the front by a plate 28 having, at the front, a flat surface 29 perpendicular to longitudinal axis 26. Surface 29 is a substantially rectangular surface similar in size to panel 13, is positioned with its own longitudinal axis perpendicular to longitudinal axis 26, and has a central cavity 30 which communicates centrally with a funnel 31 defining the output member of a suction circuit 32.

Figure 6:
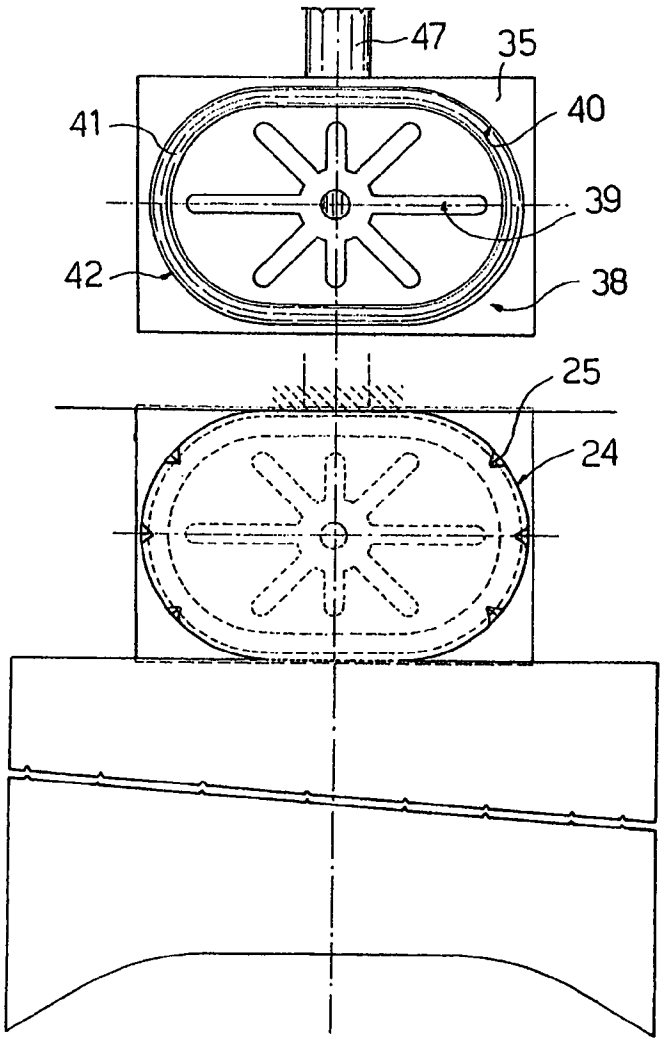
FIG. 6 shows a larger-scale plan view of a detail in FIG. 1.

Folding device 1 also comprises two folding members 33 and 34 located on opposite sides of plate 28, and each of which comprises a front plate 35 fitted at the rear with a respective appendix 36 bounded laterally by a respective pair of surfaces 37 parallel to each other and to the FIG. 1-3 planes. Each plate 35 is bounded at the front by a surface 38, in which is formed, as shown in FIG. 6, a central star-shaped cavity 39 surrounded by an annular groove 40 housing a seal 41 and having an outer edge 42 of substantially the same shape and size as panels 16 and 17.

The two folding members 33 and 34 are supported by frame 27 with the interposition of respective actuating devices 43 which are located on opposite sides of, and specularly with respect to, longitudinal axis 26, and which provide for moving respective plates 35 between a rest position (FIG. 1), in which surfaces 38 of plates 35 are coplanar with surface 29 of plate 28, and a work position (FIG. 3), in which surfaces 38 of plates 35 are perpendicular to surface 29 of plate 28, by being rotated 900, in opposite directions as of the rest position, about respective axes 44 and 45 perpendicular to the FIG. 1-3 planes and each coincident with an edge of respective plate 35 facing plate 28. More specifically, actuating devices 43 support the two folding members 33 and 34 so that the two axes 44 and 45 are parallel, are separated by a distance equal to the distance between lines 19 and 20 on blank 3, and are parallel to and face respective minor sides of plate 28.

As shown more clearly in FIG. 2, each cavity 39 communicates centrally with a respective conduit 46 formed through relative plate 35 and relative appendix 36, and in turn communicating with a curved pipe 47, which engages in axially sliding manner a respective curved conduit 48 formed through frame 27 and plate 28 about relative axis 44, 45 and terminating inside cavity 30.

As shown in FIGS. 1 and 3, each actuating device 43 comprises an articulated parallelogram transmission 49, which comprises two connecting rods 50 and 51 located on opposite sides of relative appendix 36, and hinged to appendix 36 by two pins 52 and 53 parallel to, and defining a through plane for, relative axis 44, 45. The two connecting rods 50 and 51 are supported by frame 27 with the interposition of two crank members 54 and 55, each of which comprises two superimposed arms 56 and 57, which are located on the same side as connecting rod 50 and 51 respectively, and are connected to each other by two pins 58 and 59 parallel to relative axis 44, 45 and separated by the same distance as between pin 52 and relative axis 44, 45. Pin 58 extends through frame 27, and pin 59 extends through connecting rod 50. More specifically, pin 58 of crank member 54 is a powered pin.

Arm 57 is longer than arm 56, extends beyond connecting rod 50, and is connected at its free end to connecting rod 51 by a pin 60 parallel to pins 58 and 59 and separated from pin 59 by the same distance as between pin 53 and pin 52. Crank members 54 and 55 are parallel to each other and to the plane defined by the respective pair of pins 52 and 53, so that the relative folding member 33, 34 defines, for the relative actuating device 43, a further crank which, when relative crank members 54 and 55 are rotated about the axes of relative pins 58 by pin 58 of crank member 54, rotates with respect to frame 27 and plate 28 about a virtual hinge whose axis coincides with respective axis 44, 45.

In actual use, folding device 1 is initially set to the rest position (FIG. 1) with surfaces 38 coplanar with surface 29, and blank 3 is fed onto folding device 1 so that panel 13 contacts surface 29, lines 19 and 20 are located at respective axes 44 and 45, and panels 16 and 17 contact surfaces 38 of plates 35 of respective folding members 33 and 34. At this point, blank 3 is clamped in position (FIG. 2) by feeding onto panel 13, by means of a pusher 61, a product 62 defined, in the example shown (FIG. 4), by a group 63 of cigarettes enclosed in a foil wrapping 64.

In connection with the above, it should be pointed out that panel 13 cuts off outside communication of cavity 30, while each panel 16, 17 is positioned with its periphery contacting relative seal 41, thus cutting off outside communication of relative cavity 39.

When suction circuit 32 is activated, panel 13 is clamped firmly to plate 28, and, by means of suction along conduits 48, pipes 47 and conduits 46, panels 16 and 17 are clamped firmly to respective folding members 33 and 34. In other words, the two panels 16 and 17, being sucked onto respective surfaces 38, are stiffened completely by contact with respective external elements defined by folding members 33 and 34.

At this point, pins 58 of crank members 54 of actuating devices 43 are activated to rotate folding members 33 and 34 (FIG. 2) about respective axes 44 and 45 into the work position, and so simultaneously fold panels 16 and 17 squarely about relative lines 19 and 20. Over a final portion of their rotation, folding members 33 and 34 fit rims 24 onto the respective ends of product 62 to retain product 62 transversely on plate 28.

Pusher 61 is then withdrawn and, following operation of known external folders 65 (FIG. 2) which fold panels 12 and 14 squarely about relative lines 18 and 21, is replaced by a known folding head 66 (FIG. 3) which folds the lateral portions of panels 12, 13 and 14 onto rims 24 to form lateral wall 7 and so complete packet 2.

In connection with the above, it should be pointed out that, if panels 16 and 17 were not stiffened externally, the pressure applied by panels 12, 13 and 14 on rims 24 when forming lateral wall 7 would be transmitted as a bending moment through the right-angle—which remains substantially undeformed—defined by each rim 24 and relative panel 16, 17, and could result in flexing of panels 16 and 17, and in poor connection of lateral wall 7 to rims 24. In the case of folding device 1, this is prevented by preventing panels 16 and 17 from flexing, by clamping them by suction on relative folding members 33 and 34 throughout the formation of packet 2.

Folding members 33 and 34 of folding device 1 may be replaced by straightforward walls similar to plates 35, but hinged directly to opposite edges of plate 28 by hinges whose axes, for practical reasons, cannot be located in the surface 29 plane. In this case, as opposed to being fixed like axes 44 and 45, the lines of intersection between surfaces 38 of plates 35 and surface 29 of plate 28 move towards each other along surface 29 up to lines 19 and 20, so that, as plates 35 rotate, the two panels 16 and 17 slide on relative surfaces 38 until plates 35 reach the work position. Consequently, when using hinged plates 35, panels 16 and 17 cannot be clamped from the outset to relative plates 35, and can only be stiffened by suction after being folded squarely; and panel 13, as opposed to also being clamped to plate 28 by suction, is only clamped by feeding product 62 onto plate 28.

The invention claimed is:

1. A method of producing a rigid container for a product, the container (2) comprising two end walls (5, 6) and a lateral wall (7), and being formed from a flat blank (3) comprising two first portions (16, 24; 17, 24), each of which comprises a respective panel (16; 17) defining a respective said end wall (5; 6) of the container (2), and a drawn rim (24) integral with the panel (16; 17), extending along at least one portion (22) of an outer edge of the panel (16; 17), and square with respect to the panel (16; 17); and three second portions (12, 13, 14) alternating with said two panels (16, 17), one (13) of said second portions (12, 13, 14) being an intermediate second portion with respect to said two panels (16, 17); the method comprising the steps of folding each said panel (16; 17) squarely with respect to the second portions (12, 13; 13, 14) adjacent to it, and wrapping said second portions (12, 13, 14) about and onto said rims (24) to form said lateral wall (7); and being characterized by comprising the further step of stiffening each said panel (16; 17) at least during said step of wrapping to form said lateral wall (7).

2. A method as claimed in claim 1, wherein said stiffening step is a step of clamping each said panel (16; 17) by suction onto a respective supporting surface (38).

3. A method as claimed in claim 1, wherein said step of folding said panels (16, 17) squarely comprises the substeps of clamping said intermediate second portion (13) onto a first surface (29); placing each said panel (16; 17) on a respective second surface (38) of a respective folding member (33; 34) set to a rest position in which the respective said second surface (38) is coplanar with said first surface (29); and moving each said folding member (33; 34) from said rest position to a work position in which said second surfaces (38) are square with respect to said first surface (29); each said second surface (38) defining said supporting surface for a respective said panel (16, 17).

4. A method as claimed in claim 3, wherein each said folding member (33; 34) moves between said rest position and said work position by rotating about a respective axis (44; 45) coplanar with said first surface (29).

5. A method as claimed in claim 4, wherein each said panel (16; 17) is also clamped by suction onto the respective second surface (38) during said substep of moving the relative said folding member (33; 34) from said rest position to said work position.

6. A method as claimed in claim 5, wherein said intermediate second portion (13) is clamped onto said first surface (29) by suction.

7. A method as claimed in claim 3, wherein said intermediate second portion (13) is clamped onto said first surface (29) by feeding said product (62) towards said first surface (29) and onto the intermediate second portion (13).

8. A method as claimed in claim 1, wherein each said panel (16; 17) is substantially oval.

9. A method as claimed in claim 1, wherein said product (62) comprises a group (63) of cigarettes.

* * * * *